US007406803B2

(12) United States Patent
Haberman

(10) Patent No.: US 7,406,803 B2
(45) Date of Patent: Aug. 5, 2008

(54) MULTI-MEDIA WORKSTATION HAVING A MASTER RAIL SYSTEM

(75) Inventor: William G. Haberman, Glen Head, NY (US)

(73) Assignee: Forecast Consoles, Inc., Deer Park, NY (US)

( * ) Notice: Subject to any disclaimer, the term of this patent is extended or adjusted under 35 U.S.C. 154(b) by 0 days.

(21) Appl. No.: 11/545,219

(22) Filed: Oct. 10, 2006

(65) Prior Publication Data

US 2007/0029904 A1 Feb. 8, 2007

Related U.S. Application Data

(60) Continuation of application No. 11/083,758, filed on Mar. 18, 2005, now Pat. No. 7,125,088, which is a continuation of application No. 11/005,064, filed on Dec. 6, 2004, now Pat. No. 6,986,556, which is a division of application No. 10/407,436, filed on Apr. 4, 2003, now Pat. No. 6,857,712.

(60) Provisional application No. 60/370,070, filed on Apr. 4, 2002.

(51) Int. Cl.
*E04H 14/00* (2006.01)

(52) U.S. Cl. ..... 52/236.1; 52/36.1; 52/169.5; 52/293.3

(58) Field of Classification Search ..... 52/36.1, 52/169.5, 562, 293.3, 261, 236.1
See application file for complete search history.

(56) References Cited

U.S. PATENT DOCUMENTS 4,382,642 A 5/1983 Burdick
4,836,625 A 6/1989 Catta
4,838,177 A 6/1989 Vander Park
4,852,500 A 8/1989 Ryburg et al.
4,974,913 A 12/1990 Vogt et al.
5,337,525 A 8/1994 Zaccai et al.
5,428,928 A 7/1995 Hellwig et al.
5,537,290 A * 7/1996 Brown et al. ..... 361/681
5,678,907 A * 10/1997 Schainholz ..... 312/223.6
5,697,589 A * 12/1997 Garfinkle ..... 248/223.41
5,746,488 A 5/1998 LaCour
5,921,052 A 7/1999 Kemp
5,954,409 A 9/1999 LaCour
5,974,985 A 11/1999 Flototto et al.
6,042,203 A 3/2000 Bogucki
6,050,659 A 4/2000 LaCour (Continued)

OTHER PUBLICATIONS

"Series 200 Console System" product brochure pp. 4, 5, 7 and 8. Publication Date Unknown.

(Continued)

*Primary Examiner*—Basil Katcheves
(74) *Attorney, Agent, or Firm*—Hoffman & Baron, LLP

(57) ABSTRACT

A multi-media workstation having a master rail system for permitting horizontal adjustment of the various components of the workstation. The workstation generally includes a console having a work surface and a master rail system for supporting various audiovisual equipment. The master rail system includes a rail extrusion connecting at least two frames and having a longitudinal slot formed in at least one of its surfaces. The various components of the workstation each include a finger engaged in the longitudinal slot of the rail extrusion, wherein the component is able to be horizontally translated along a length of the rail extrusion.

20 Claims, 9 Drawing Sheets

U.S. PATENT DOCUMENTS

| | | | | |
|---|---|---|---|---|
| 6,076,903 | A * | 6/2000 | Vander Park | 312/196 |
| 6,152,048 | A | 11/2000 | Vander Park | |
| 6,189,268 | B1 | 2/2001 | Carr et al. | |
| 6,279,761 | B1 | 8/2001 | Niewiadomski | |
| 6,283,043 | B1 | 9/2001 | Stern et al. | |
| 6,302,035 | B1 | 10/2001 | Frenkler et al. | |
| D473,078 | S | 4/2003 | Haberman | |
| 6,619,765 | B2 | 9/2003 | Visser et al. | |
| 6,857,712 | B1 | 2/2005 | Haberman | |
| 6,892,650 | B2 * | 5/2005 | Baloga et al. | 108/50.01 |
| 6,931,795 | B1 * | 8/2005 | Baloga et al. | 52/36.1 |
| 7,125,088 | B2 * | 10/2006 | Haberman | 312/223.3 |
| 2003/0020381 | A1 | 1/2003 | Cattaneo | |
| 2003/0071546 | A1 | 4/2003 | Gosling et al. | |
| 2004/0035332 | A1 | 2/2004 | Lin | |

OTHER PUBLICATIONS

TBC Consoles "NBC Olympics Master Worksheet," bearing date Jan. 9, 2000.

TBC Consoles "Production Series PSO Modular System" Date Unknown.

"USA Networks—NOC Multi-Channel Room" Date Unknown.

TBC Consoles "Graphics Console" bearing date Mar. 28, 2001.

Untitled Photograph of desk supporting plasma monitors, Date Unknown.

TBC Consoles "Lockheed Martin Overseas—LCD Consoles" bearing date Oct. 10, 2001.

TBC Consoles "News 12 Connecticut—PS2-4" Shop Drawing, bearing date Nov. 10, 2002.

Evans Consoles, Inc. brochure entitled "Series 200," publication date unknown.

Item MB Kit Systems, LTD, drawing entitled "Line 8 Light Black," dated Nov. 29, 2001.

Drawings entitled "MCC Sectional Elevation," publication date unknown.

* cited by examiner

10

MULTI-MEDIA WORKSTATION HAVING A MASTER RAIL SYSTEM

CROSS-REFERENCE TO RELATED APPLICATIONS

This application is a continuation application of U.S. application Ser. No. 11/083,758, filed Mar. 18, 2005 now U.S. Pat. No. 7,125,088, which is a continuation application of U.S. application Ser. No. 11/005,064, filed Dec. 6, 2004, now U.S. Pat. No. 6,986,556, which is a divisional application of U.S. application Ser. No. 10/407,436, filed Apr. 4, 2003, now U.S. Pat. No. 6,857,712, which claims the benefit of U.S. Provisional Application No. 60/370,070, filed on Apr. 4, 2002.

FIELD OF THE INVENTION

The present invention relates generally to multi-media workstations for supporting various electronic equipment, and more particularly to a modular workstation console having a master rail system that provides for full horizontal adjustment of the various components of the workstation.

BACKGROUND OF THE INVENTION

Workstations for mounting audio-visual, electrical, communication and computer equipment are well known and are available from different manufacturers. It is also known to construct office workstations in a modular fashion that permits a wide variety of furniture groupings or arrangements. However, if numerous electrical components are required together in a relatively small workstation space, it becomes essential to easily arrange such components in a compact manner whereby the equipment is comfortably and conveniently accessible to the user or users. Efficient routing of the electrical wiring and cables so as not to detract from the appearance of the workstation also becomes an issue. Wiring and cables should be located away from the floor areas where persons might trip on them and should be easily accessible for service personnel.

Some particular environments that require increasingly complicated and sophisticated workstations include television studios, radio stations, security centers, air traffic control centers and financial and brokerage institutions where users typically need access to numerous television monitors, computer displays, data processors and telecommunications equipment arranged in a side-by-side manner. In such environments, workstations are typically custom built and installed by the manufacturer based on the user's particular equipment requirements. As such, the workstation arrangement for supporting the various electronic components is usually permanently fixed. If it later becomes necessary to expand the workstation or rearrange the electronic components, the workstation must be rebuilt or replaced. The result is that the workstation may be put out of use during the modification or expansion. Thus, such known workstations are not optimally suited for use in a dynamic work environment, where workspaces are ideally capable of rapid configuration and reconfiguration by the workers themselves in a highly efficient manner.

Accordingly, it would be desirable to provide a flexible, modular workstation that permits the user to easily adjust the positions of the various components of the workstation as desired. Additionally, it would be desirable to provide such a workstation that is adapted to allow mounting of additional equipment or components and that can be easily connected to other workstations.

SUMMARY OF THE INVENTION

The present invention is a multi-media workstation having a master rail system for permitting horizontal adjustment of the various components of the workstation. The workstation generally includes a console having a work surface and a master rail system for supporting various audiovisual equipment.

In a preferred embodiment, the multi-media workstation includes at least two vertical frames having an upper mounting surface thereon, a first rail extrusion mounted to the mounting surface of the vertical frames and connecting the frames, a second rail extrusion mounted to the mounting surface of the vertical frames and connecting the frames, a desktop unit mounted to the first rail extrusion and a console box, for supporting a piece of audiovisual equipment, mounted to the second rail extrusion. The first rail extrusion has an upper surface, a lateral surface and a longitudinal slot formed in at least one of the upper and lateral surfaces. The second rail extrusion has an upper surface and a longitudinal slot formed in the upper surface. The longitudinal slots are preferably T-shaped. The second rail extrusion is mounted to the mounting surface of the vertical frames such that the upper surface of the second rail extrusion is disposed at a downward angle with respect to the upper surface of the first rail extrusion. The desktop unit has a finger engaged in the longitudinal slot of the first rail extrusion, wherein the desktop unit is able to be horizontally translated along a length of the first rail extrusion. Similarly, the console box has a finger engaged in the longitudinal slot of the second rail extrusion, wherein the console box is able to be horizontally translated along a length of the second extrusion.

Preferably, the workstation further includes a bracket assembly connected between the first and second rail extrusions. The bracket assembly includes a flat panel extending between the first and second rail extrusions and at least one bracket for supporting the flat panel. The flat panel encloses a cavity between the first rail extrusion, the second rail extrusion and the vertical frames for containing electrical wiring for the workstation therein. Additionally, the flat panel includes at least one grommet opening for accessing the electrical wiring contained within the cavity.

The desktop unit preferably includes a work surface and at least two desktop brackets for supporting the work surface. The desktop brackets each include a finger engaged in the longitudinal slot of the first rail extrusion.

Furthermore, the first rail extrusion preferably includes a second longitudinal slot formed in one of the upper and lateral surfaces and the workstation further preferably includes a support stand for supporting a second piece of workstation equipment. The support stand has a finger engaged in the second longitudinal slot of the first rail extrusion, wherein the support stand is able to be horizontally translated along a length of the first rail extrusion.

Thus, the console includes a plurality of rigid steel frames, which are spaced at various intervals along the length of the console. The master rail system is integrated into the frames of the console for providing maximum horizontal adjustability of the various components of the workstation. The first and second rail extrusions can include a plurality of T-shaped slots formed therein along the entire length of the extrusion. The flat panel spoil board is essentially a flat plate connecting the first and second rail extrusions and extending along the length of the console. The spoil board encloses a cavity to contain electrical wiring for the various components of the workstation along the length of the console.

In an alternative embodiment, the first rail extrusion, the second rail extrusion and the spoil board can be integrated into a single extrusion mounted to the top of the console. Thus, in this embodiment, the workstation generally includes at least two vertical frames having an upper mounting surface thereon, a rail extrusion mounted to the mounting surface of the vertical frames and connecting the frames, a desktop unit mounted to the rail extrusion and a console box, for supporting a piece of audiovisual equipment, mounted to the rail extrusion. The rail extrusion includes a first portion having an upper surface, a lateral surface and a longitudinal slot formed in at least one of the upper and lateral surfaces. The rail extrusion further includes a second portion having an upper surface and a longitudinal slot formed in the upper surface. Again, the longitudinal slots are preferably T-shaped. The upper surface of the second portion is formed at a downward angle with respect to the upper surface of the first portion. The desktop unit has a finger engaged in the longitudinal slot of the first portion of the rail extrusion, wherein the desktop unit is able to be horizontally translated along a length of the first portion of the rail extrusion. Similarly, the console has a finger engaged in the longitudinal slot of the second portion of the rail extrusion, wherein the console box is able to be horizontally translated along a length of the second portion of the rail extrusion.

Preferably, the rail extrusion further includes a web portion connecting the first and second portions. The web portion includes at least one longitudinal cavity formed therein, for containing electrical wiring for the workstation, and at least one grommet opening for accessing the electrical wiring contained within the cavity. Additionally, the single extrusion can be formed with a plurality of T-shaped slots extending the entire length of the single extrusion.

In another alternative embodiment, the multi-media workstation includes at least two vertical frames, wherein each frame has an aperture therethrough and at least one finger extending inwardly into the aperture. A rail extrusion is slidingly received in the aperture of each of the vertical flames and connects the frames. The rail extrusion has a perimeter surface and at least one longitudinal slot formed in the perimeter surface. The slot engages the fingers of the vertical frames, wherein the vertical frames are able to be horizontally translated along a length of the rail extrusion. Similar to that described above, the workstation in this embodiment also includes a desktop unit having a finger engaged in the longitudinal slot of the rail extrusion, wherein the desktop unit is able to be horizontally translated along a length of the rail extrusion. The rail extrusion of this embodiment preferably has a circular cross-section and a plurality of longitudinal slots formed in around the perimeter surface at spaced locations.

Again, a console box unit can also be mounted to the rail extrusion. However, in this embodiment, the console box unit preferably includes a console box and a console box bracket. The console box bracket includes an aperture therethrough and at least one finger extending inwardly into the aperture. The aperture slidingly receives the rail extrusion and the finger engages the longitudinal slot of the rail extrusion, wherein the console box unit is able to be horizontally translated along a length of the rail extrusion.

The desktop unit also preferably includes a worksurface and at least two desktop brackets fixed to a bottom surface thereof. Each of the desktop brackets includes an aperture therethrough and at least one finger extending inwardly into the aperture. The aperture slidingly receives the rail extrusion and the finger engages the longitudinal slot of the rail extrusion.

Additionally, the workstation may also include a shelf unit mounted to the rail extrusion, wherein the shelf unit is able to be horizontally translated along a length of the rail extrusion. The shelf unit preferably includes a flat surface and a shelf bracket fixed to a bottom surface thereof. The shelf bracket includes an aperture therethrough and at least one finger extending inwardly into the aperture. The aperture slidingly receives the rail extrusion and the finger engages the longitudinal slot of the rail extrusion. The shelf unit is preferably spaced vertically higher than the desktop unit and the console box unit is positioned between the shelf unit and the desktop unit.

Thus, the workstation of this embodiment can include a master rail system consisting of an extruded rail having a circular cross-section and a plurality of T-slots formed along the length of the rail and angularly spaced around its circumference. In this manner, the electronic components and the work surface are mounted to the rail system and can be both horizontally and angularly adjusted to suit the user's needs. Additionally, the various components of the workstation can be interchanged and new components can be added to suit the user's needs.

In all embodiments of the present invention, the various electrical components of the workstation are mounted to the master rail system in such a manner that they can be horizontally adjusted to suit any need. Additionally, the work surface is also mounted to the master rail system and is also provided with horizontal adjustment. In particular, the electrical components and the work surface are provided with mounting provisions which are inserted within and engage the T-shaped slots of the master rail system. The mounting provisions permit horizontal translation of the components and the work surface along the entire length of the T-slot in the master rail system. As a result of the present invention, a totally adjustable and interchangeable workstation system is provided.

Other objects and features of the present invention will become apparent from the following detailed description considered in conjunction with the accompanying drawings. It is to be understood, however, that the drawings are designed as an illustration only and not as a definition of the limits of the invention.

DETAILED DESCRIPTION OF THE PREFERRED EMBODIMENTS

Figure 1:
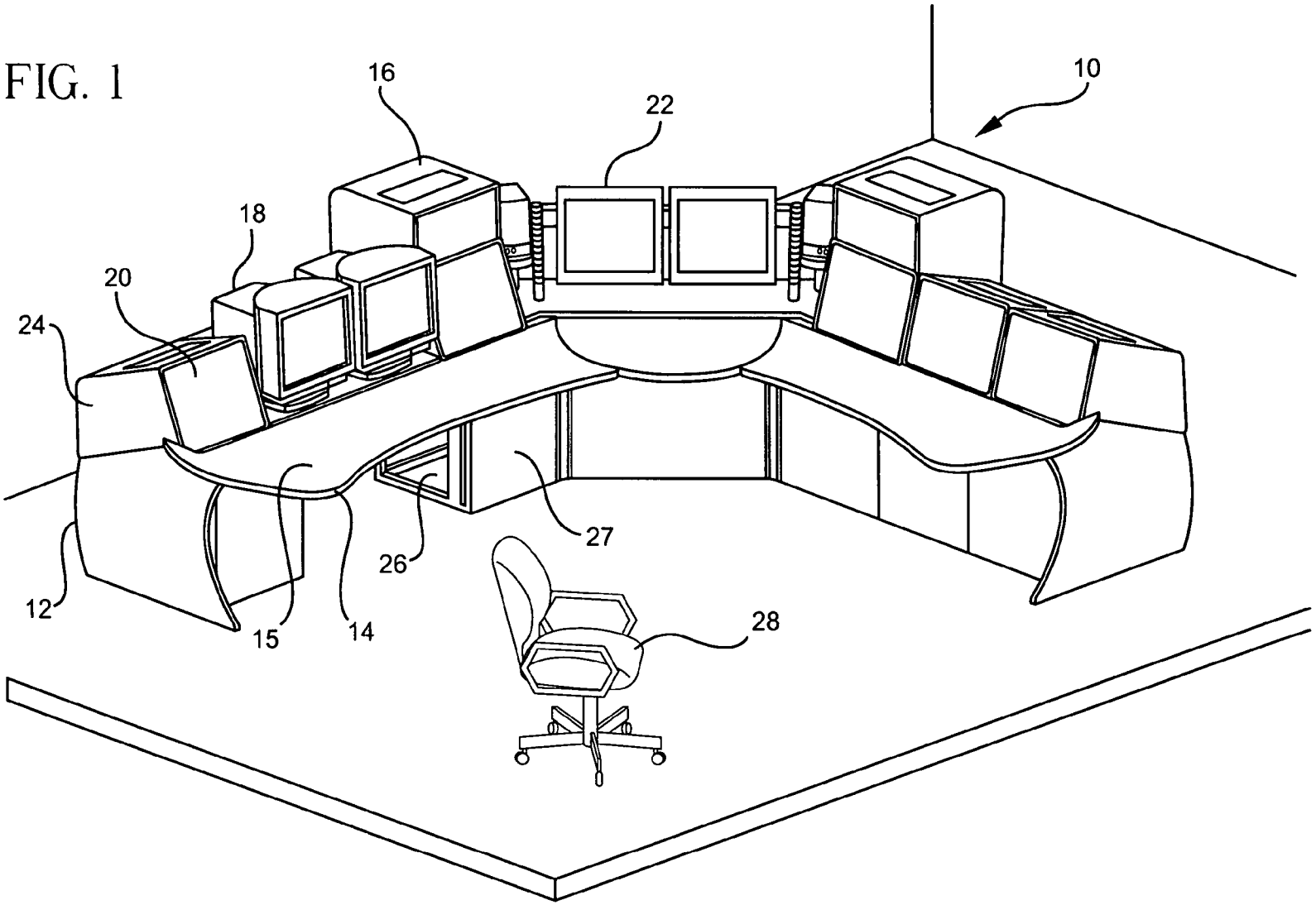
FIG. 1 is a top perspective view of the multi-media workstation formed in accordance with the present invention.

FIG. 1 shows a multi-media workstation 10 formed in accordance with the present invention. This type of workstation can typically be found at a control center for monitoring and controlling audiovisual equipment. Such workstations can be found, for example, in television studios, radio stations, security centers, air traffic control centers and financial and brokerage institutions.

The workstation 10 includes a console 12 having a desktop unit 14 including a flat work surface or desktop 15. The console 12 supports various audiovisual equipment such as computers 16, computer monitors 18, television monitors 20 and flat monitors 22. Television monitors 20 are typically mounted to and contained within standard-sized console boxes 24, which are also part of console 12. The supporting electronic hardware 26 can be stored within cabinets 27 provided below the desktop 14 of the console 12. One or more rolling chairs 28 are also typically provided to allow the operator(s) to monitor the equipment and to comfortably move from one piece of equipment to the other as required.

Figure 2:
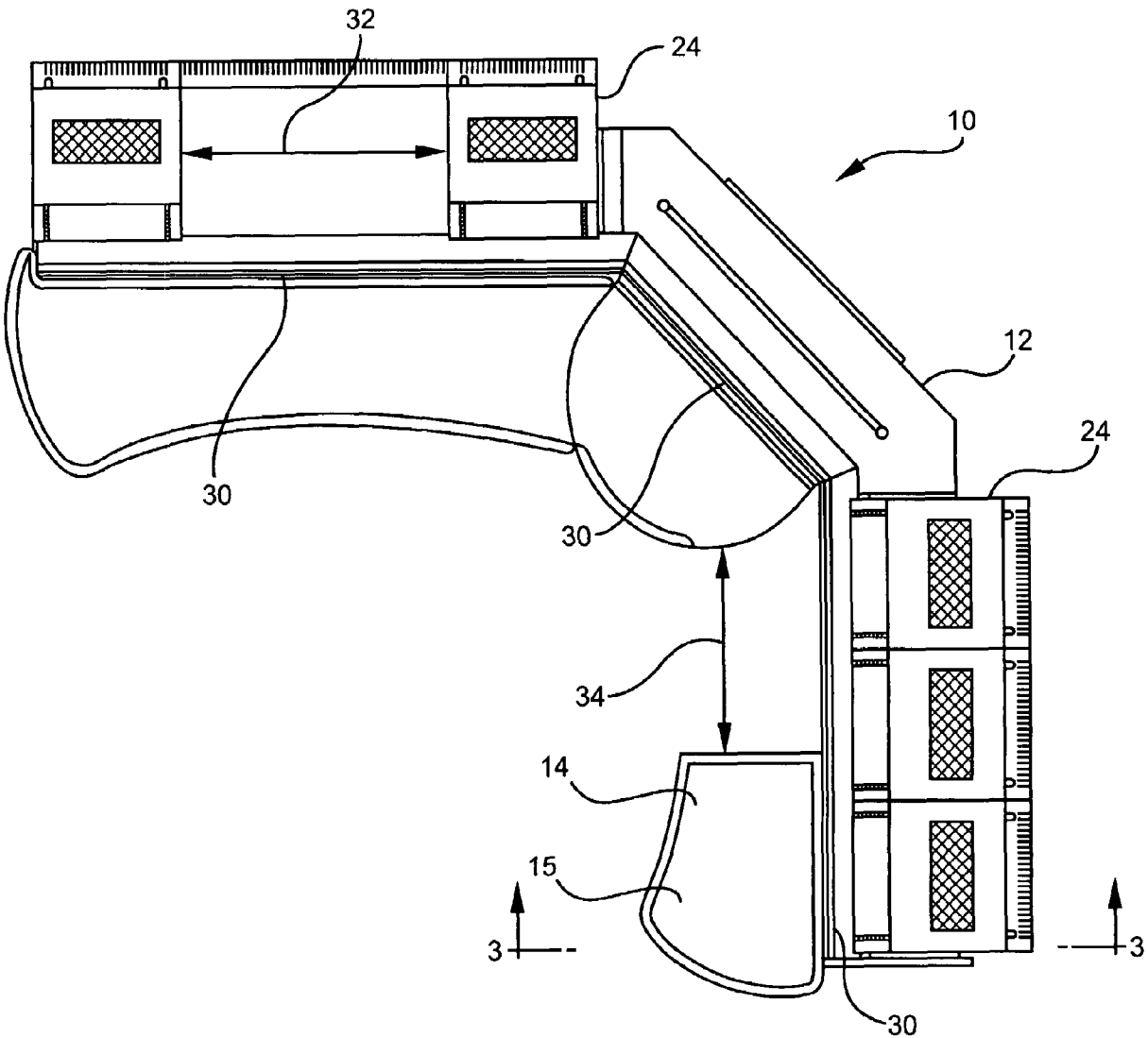
FIG. 2 is a top plan view of the workstation shown in FIG. 1.
Figure 3:
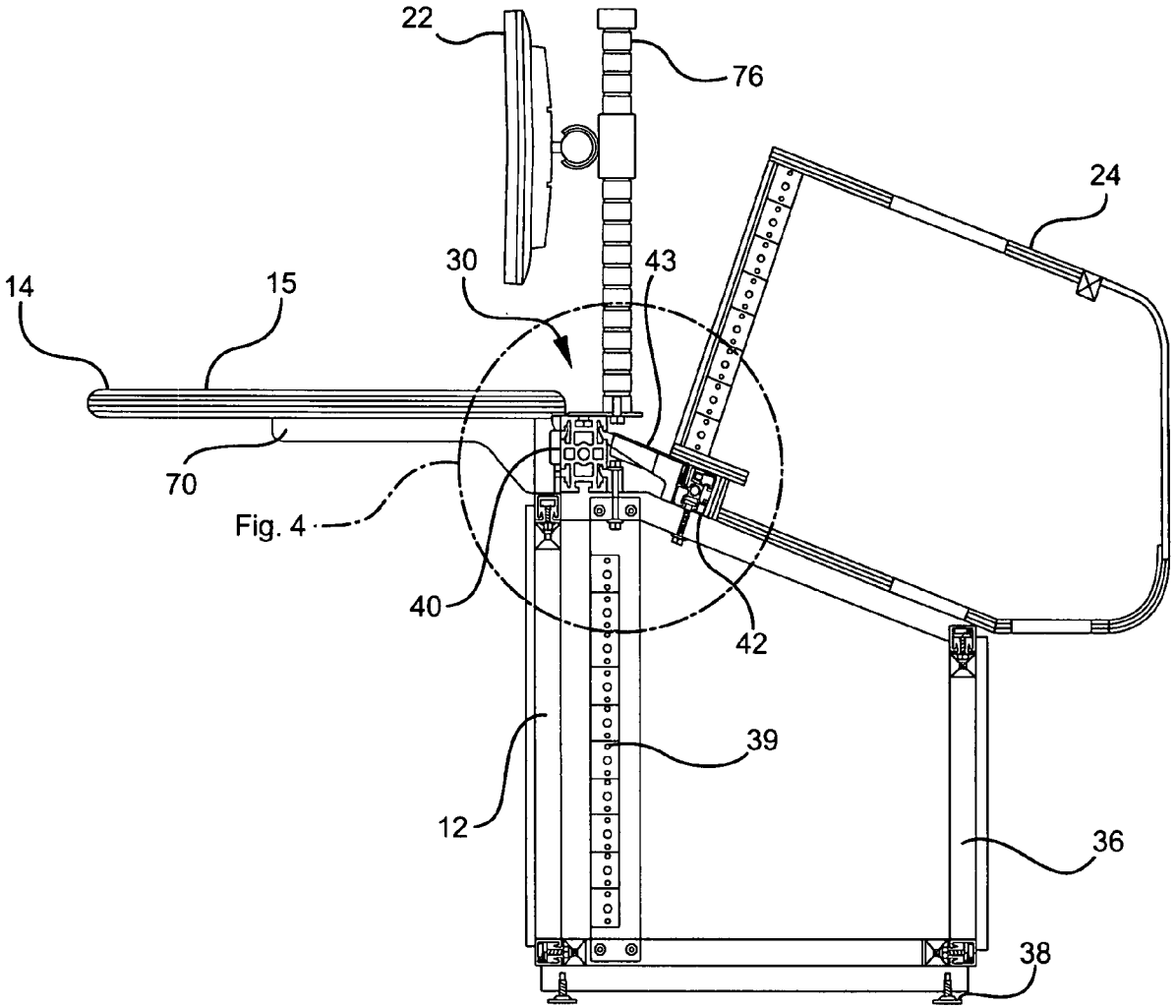
FIG. 3 is a side view of the workstation shown in FIG. 2 taken along line 3-3.
Figure 4:
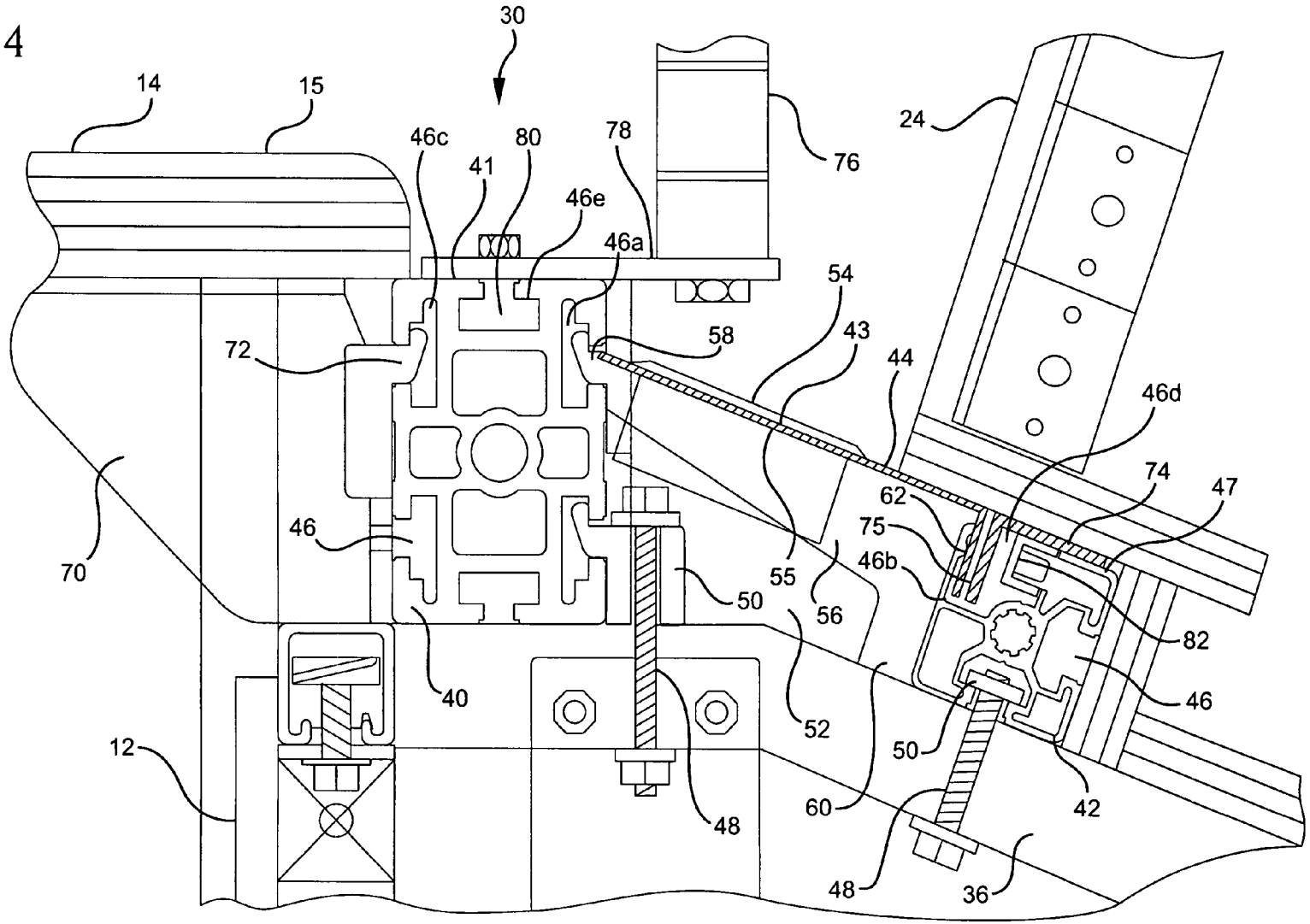
FIG. 4 is an expanded detailed view of the master rail system shown in FIG. 3 as indicated by the dotted line 4.

Referring now to FIGS. 2-4, the console 12 of the present invention includes a master rail system 30 integrated into the frame of the console for providing maximum horizontal adjustability of the various components of the workstation 10. In particular, the master rail system 30 allows for horizontal movement of the console boxes 24, as indicated by arrows 32, as well as horizontal movement of one or more desktops 14, as indicated by arrows 34. As will be discussed in further detail below, the master rail system 30 additionally includes provisions for mounting and horizontally adjusting the position of other secondary or auxiliary equipment between the desktop 14 and the console boxes 24.

Referring to FIGS. 3 and 4, which are cross-sectional and expanded cross-sectional views respectively of the workstation 10 of FIG. 2, the console 12 includes a plurality of rigid steel frames 36, which are spaced at various intervals along the length of the console 12. The frames 36 may be of a welded construction and may include feet 38 for resting on the floor. The frames 36 may be connected from one to the other with brackets 39 to add rigidity and strength to the console 12. Mounted at the tops of the frames 36 is the master rail system 30, which extends the full length of the console 12. The master rail system 30 includes a first rail extrusion 40, a second rail extrusion 42 and a bracket assembly 43 including a spoil board 44 connected between the first and second rail extrusions.

Referring now specifically to FIG. 4, the first and second rail extrusions 40 and 42 are made from a metallic material, such as aluminum, and include a plurality of T-shaped slots 46 formed therein along the entire length of the extrusion. Preferably, the first rail extrusion 40 is rectangular in shape having two T-slots 46 on each lateral side and having a T-slot on both its upper and lower faces. The second rail extrusion 42 is preferably square in cross-section having a T-slot 46 formed on each side. The first and second rail extrusions 40 and 42 are mounted to the steel frames 36 by conventional bolts 48 having fittings 50 that engage one or more of the T-slots 46 of the rail extrusions.

The spoil board 44 is essentially a flat plate connecting the first and second rail extrusions 40 and 42 and extending along the length of the console 12. The spoil board 44 encloses a cavity 52 between the first rail extrusion 40, the second rail extrusion 42 and the steel frame 36 to contain electrical wiring for the various component of the workstation 10 along the length of the console 12. Standard wiring grommets 54 are provided at spaced openings 55 in the spoil board 44 for routing wires from the cavity 52 to the various electrical components mounted to the console 12. The spoil board 44 is supported by a plurality of spoil board brackets 56 intermittently spaced along the length of the spoil board 54. The spoil board brackets 56 include a finger 58 which is sized to fit within and engage an upper side T-slot 46*a* of the first rail extrusion 40. The opposite end of the spoil board bracket 56 includes a leg 60 which rests on the steel frame 36 of the console 12 for supporting the spoil board 44. The spoil board 44 includes a bent edge 62 which fits within the upper T-slot 46*b* of the second rail extrusion 42. In this manner, the spoil board 44 is connected between the first and the second rail extrusions 40 and 42.

Figure 5:
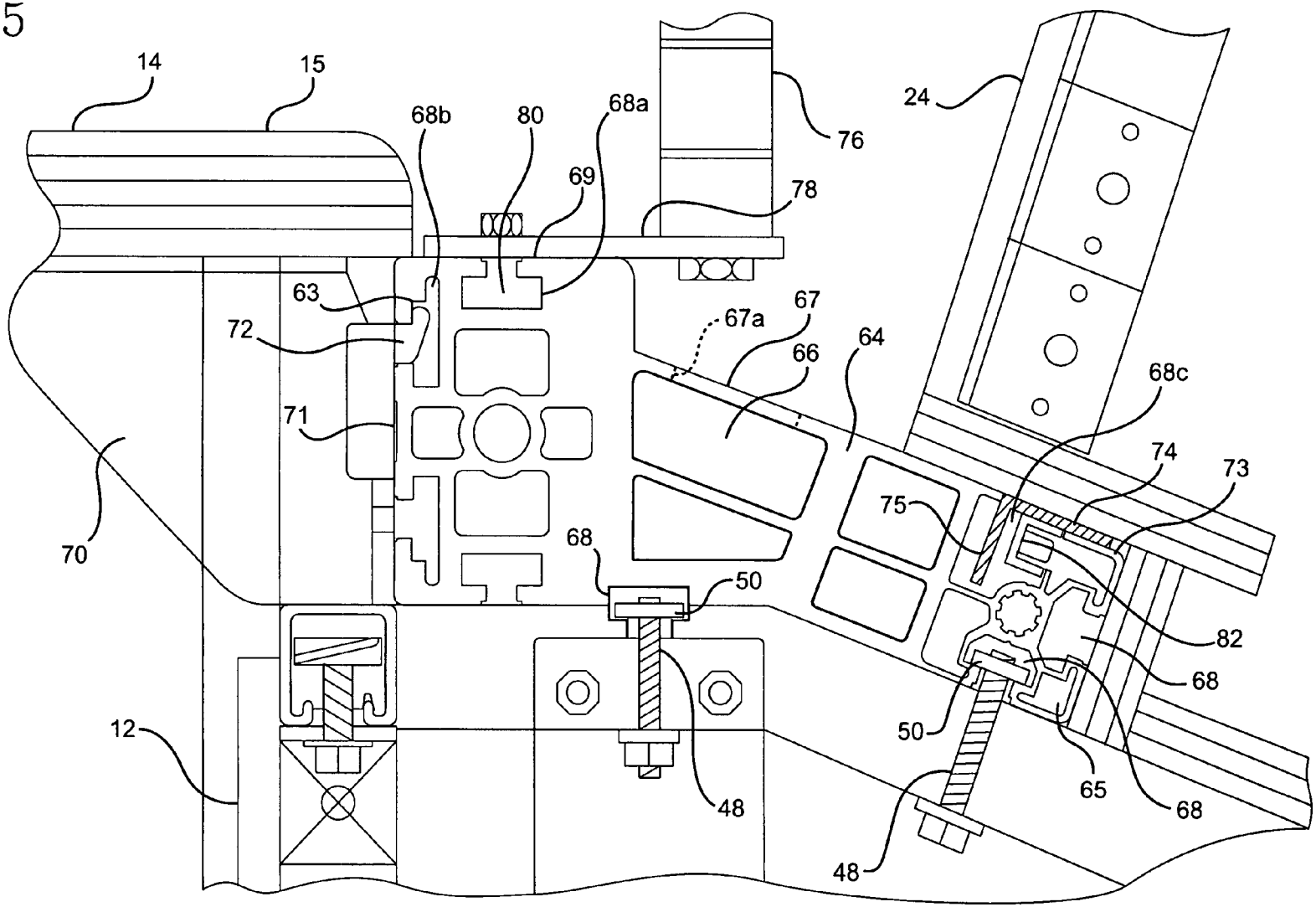
FIG. 5 is an expanded detailed view of an alternative embodiment of the master rail system shown in FIG. 4.

In an alternative embodiment, as shown in FIG. 5, the first rail extrusion 40, the second rail extrusion 42 and the spoil board 54 can be integrated into a single extrusion 64 mounted to the top of the console 12. The single extrusion 64 includes a first portion 63, similar to the first extrusion 40, a second portion 65, similar to the second extrusion 42, and a web portion 67, similar to the bracket assembly 43, connecting the first and second portions. Like the first and second rail extrusions 40 and 42 described above, the first and second portions 63 and 65 of the single extrusion 64 are formed with a plurality of T-shaped slots 68 extending the entire length of the single extrusion. Preferably, there is at least one T-slot 68*a* formed on a top surface 69 of the first portion 63, one or more T-slots 68*b* formed on a side surface 71 of the first portion perpendicular to the top surface, and at least one T-slot 68*c* formed on an inclined surface 73 of the second portion 65. Here, the upper surface 73 of the second portion 65 is formed at an angle with respect to the upper surface 69 of the first portion 63.

The single extrusion 64 further preferably includes one or more wire cavities 66 formed in the web portion 67 and extending along the length of the extrusion and access openings 67*a* intermittently spaced along the length of the extrusion for routing wires from the cavity 66 to the various electrical components mounted to the console 12. The single extrusion 64 is mounted to the steel frames 36 in a manner similar to the first and second rail extrusions 40 and 42 by means of conventional bolts 48 and T-slot fittings 50 that engage T-slots 68 formed in the single extrusion 64.

Returning to FIGS. 3 and 4, the various electrical components of the workstation 10 are mounted to the master rail system 30 in such a manner that they can be horizontally adjusted to suit any need. Additionally, the desktop 14 unit is also mounted to the master rail system 30 and is also provided with horizontal adjustment. In particular, each desktop unit 14 includes a flat worksurface 15 and at least two desktop brackets 70 fixed to an underside thereof. The desktop bracket 70 includes a finger 72 formed on the inside edge thereof, which is sized to fit within and engage one of the T-slots 46 of the master rail system 30. Preferably, the desktop bracket 70 is mounted to an upper side T-slot 46*c* of the first rail extrusion 40 opposite the T-slot 46*a* for mounting the spoil board 44. The finger 72 of the desktop bracket 70 is shaped for insertion into the T-slot 46*c* and grips the inside surface of the T-slot. However, the finger 72 permits horizontal translation of the bracket 70 along the length of the T-slot 46*c*. Thus, the desktop 14 can be moved to any desirable location along the length of the rail system 30.

The console boxes 24 are also mounted on the rail system 30 with the ability to translate horizontally. The console box 24 is typically a wooden rectangular structure for mounting a computer or television monitor therein. However, the console box 24, of the present invention includes a right angle 74 fixed to a bottom surface thereof. One leg of the angle is fixed to the bottom of the console box while the other perpendicular leg forms a finger 75 which is seated in the top T-slot 46*d* of the second rail extrusion 42. With the finger 75 of the angle 74 seated within the T-slot 46*d* of the second rail extrusion 42, the console box 24 is prevented from moving forward or backward. However, the T-slot 46*d* permits the console box 24 to translate horizontally along the length of the T-slot. Preferably, the top of the steel frame 36 is inclined so that the upper surface 47 of the second rail extrusion 42 is disposed at a downward angle with respect to the upper surface 41 of the first rail extrusion 40 when both are mounted to the steel frame. Thus, when mounted to the second rail extrusion 42, the console box 24 will be oriented at a slight downward angle with respect to the desk top 14 for ergonomic purposes.

The upper T-slot 46*e* of the first rail extrusion 40 is used for mounting additional workstation components to the console 12. For example, FIG. 3 shows a flat screen monitor 22 attached to a vertical support stand 76, which in turn is mounted to the upper T-slot 46*e* of the first rail extrusion 40. The vertical support stand 76 includes a leg 78 having a T-shaped finger or fitting 70 fixed thereto, for example, by a bolt. The T-shaped fitting 80 of the support stand 76 engages the inner surfaces of the T-slot 46*e* to maintain the support stand 76 in a vertical orientation. However, the T-shaped fitting 80 is permitted to translate horizontally along the length of the first rail extrusion 40. Thus, the flat screen monitor 22 can be horizontally translated to any desired location on the console 12. While a flat screen monitor 22 is shown attached to the upper T-slot 46*e*, other types of equipment, such as script stands, microphone stands, lighting fixtures etc., can also be interchangeably attached to the rail system. To reduce frictional wear within the T-slots 46, the T-slots can be provided with Teflon™ caps 82.

It is to be understood that the attachment of the console box 24, the desktop 14 and the vertical support stand 76 to the single rail extrusion 64 shown in FIG. 5 is similar to that as shown and described with respect to the first and second rail extrusions 40 and 42. In particular, the longitudinal T-slots 68 of the single rail extrusion 64 allow for mounting and horizontal translation of all the components of the workstation 10.

The workstation 10 is shown in FIGS. 1-5 in an L-shaped configuration consisting of two end pieces and a corner piece. However, it is conceivable that the workstation 10 of the present invention can take any desired configuration, for example, a straight configuration, a rectangular configuration, etc. Moreover, two or more consoles 12 can be connected to form a larger work station. In this case, longer master rail systems 30 can be utilized or a bridge can be constructed between existing rail systems. Additionally, the console 12 of the present invention can be separated into individual workstations 100, each having its own master rail system, as shown in FIG. 6.

Figure 6:
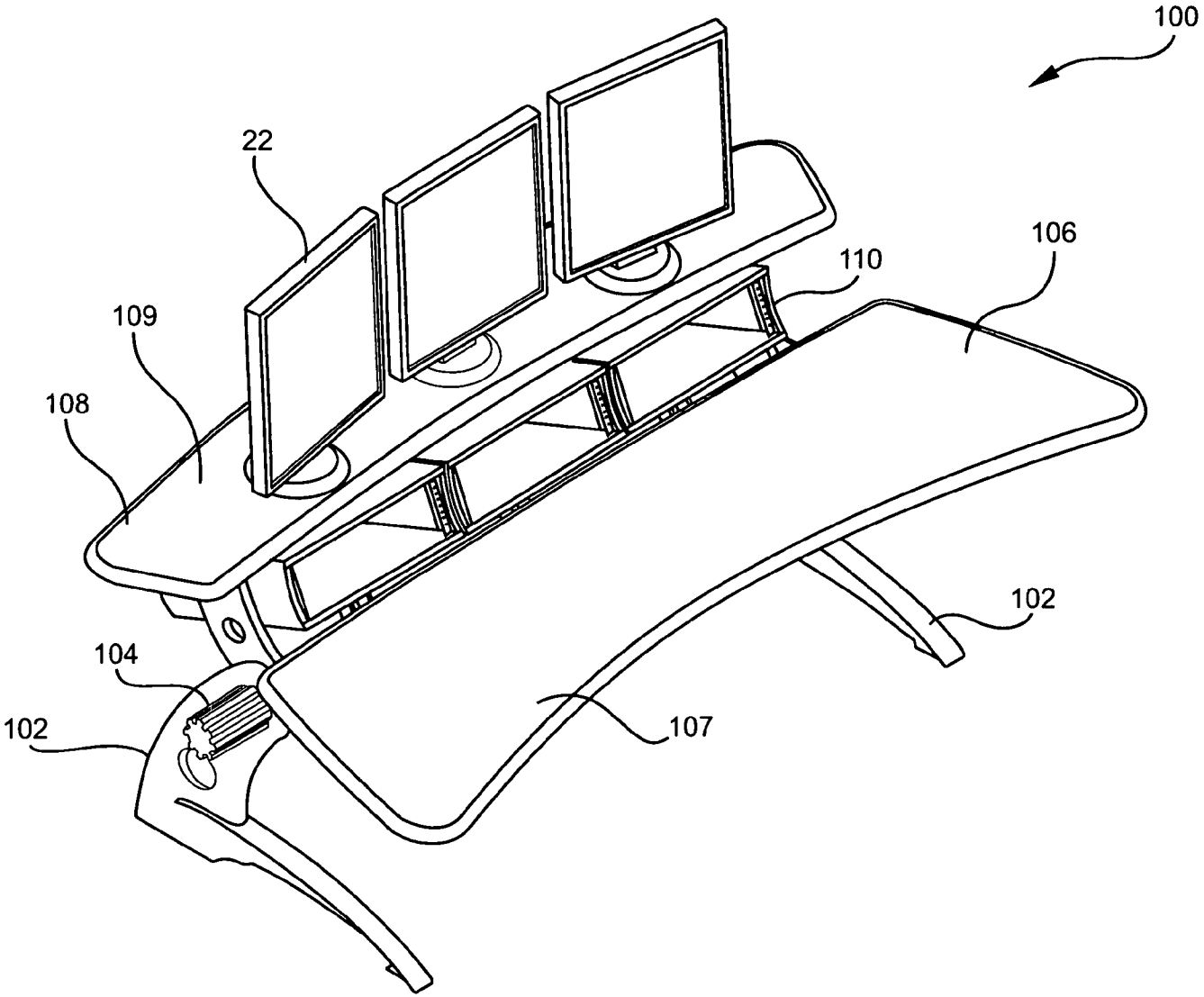
FIG. 6 is a top perspective view of an alternative embodiment of the multi-media workstation formed in accordance with the present invention.

The workstation 100 shown in FIG. 6 can be adapted for individual use, such as with home computers. The workstation 100 generally includes two vertical frames or legs 102 an extruded rail 104 connecting the two legs, a desktop unit 106 supported on the rail 104 and a shelf unit 108 also supported on the rail. The desktop unit 106 provides a working surface 107 for the user and a surface for a computer keyboard, for example. The shelf unit 108 is spaced vertically higher than the desktop 106 for supporting one or more computer monitors at eye level to the user. The workstation 100 can further be provided with console boxes 110, which are also supported on the rail 104, for containing electrical components such as computer hard drives, or audio visual equipment.

Figure 7:
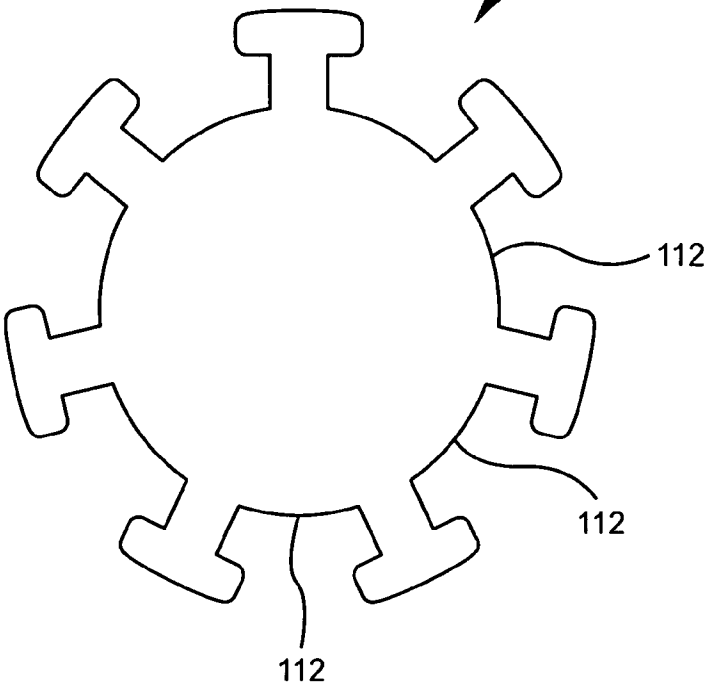
FIG. 7 is a cross-sectional view of the extrusion shown in FIG. 6.

Referring additionally to FIG. 7, an alternative embodiment for the master rail system is shown incorporated into the workstation 100 of FIG. 6. The alternative master rail embodiment consists of an extruded rail 104 having a circular cross-section and a plurality of T-slots 112 formed along the length of the rail and angularly spaced around its circumference. Again, the rail 104 is preferably made from a metallic material, such as aluminum.

Figure 8:
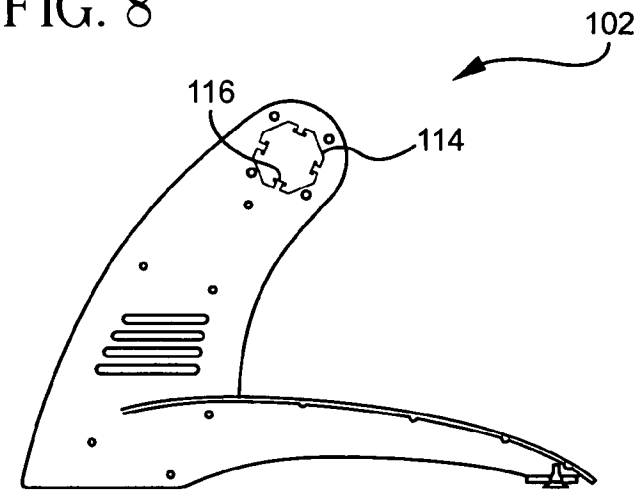
FIG. 8 is a side view of the work station leg shown in FIG. 6

The rail 104 fits within an aperture or opening 114 of each of the legs 102, as shown in FIG. 8. The opening 114 of the legs 102 includes at least one inwardly projecting T-shaped finger 116 which engages the T-slot 112 of the rail 104 to prevent rotational movement of the leg and the rail. The legs 102 are simply slid along the length of the rail 104 to their desired position.

Figure 9:
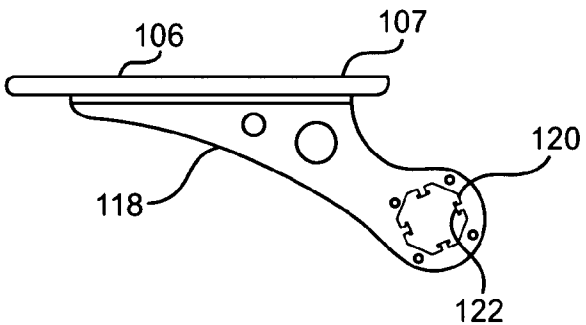
FIG. 9 is a side view of desktop bracket shown in FIG. 6.

Referring to FIG. 9, the desktop unit 106 includes a worksurface 107 and at least two desktop brackets 118 fixed to the bottom surface thereof. Each desktop bracket 118 has an opening 120 for receiving the rail 104. The opening 120 of the desktop bracket 118 similarly includes inwardly projecting fingers 122 which engage the T-slots 112 of the rail 104 to prevent rotational movement of the desktop 106 with respect to the rail. However, because the T-slots 112 of the rail 104 extend the entire length of the rail, the desktop 106 and the legs 102 can be adjusted horizontally along the rail as desired.

Figure 10:
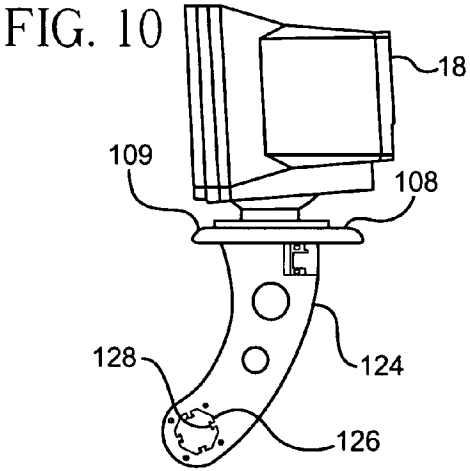
FIG. 10 is a side view of the shelf bracket shown in FIG. 6.

Referring now to FIG. 10, the shelf unit 108 similarly includes a flat surface 109 and at least two shelf brackets 124 fixed to a bottom surface thereof. The shelf bracket 124 also has an opening 126 formed therethrough for receiving the rail 104. The shelf bracket 124 also includes fingers 128 which project inwardly into the opening 126 for engaging the T-slots 112 of the rail 104 to prevent rotational movement of the shelf 108.

Figure 11:
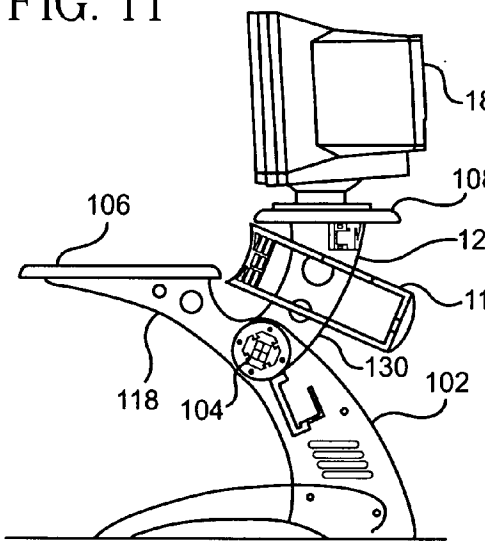
FIG. 11 is a side view of the assembled workstation shown in FIG. 6.

FIG. 11 is a side view of an assembled workstation 100 including legs 102 circular rail extrusion 104, desktop 106 and shelf 108. As mentioned above, one or more console boxes 110, for containing computer hardware for example, can additionally be mounted to the rail 104. The console box 110 would therefore include a console box bracket 130 having an opening with inwardly projecting fingers for engaging the rail 104. The circular rail extrusion 104 of the present invention allows the desktop 106, the shelf 108 and/or the console box 110 to be positioned in any desired angular orientation depending on which T-slots 112 are chosen. For example, the console box 110 is shown in FIG. 11 oriented at a slight downward angle with respect to the desktop 106.

Figure 12:
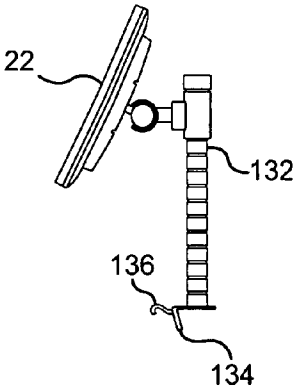
FIG. 12 is a side view of an additional support stand.
Figure 14:
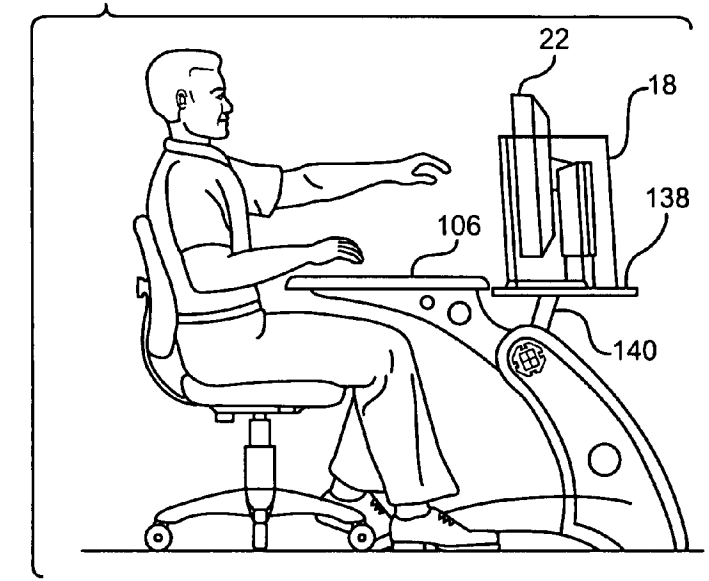
FIG. 14 is a side view of an alternative configuration of the workstation shown in FIG. 6.
Figure 13:
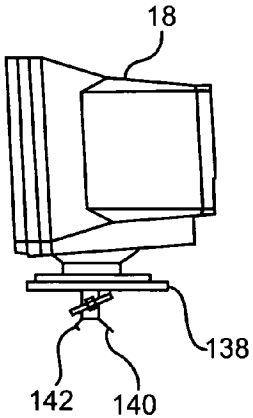
FIG. 13 is a side view of another additional support stand.

It can be appreciated that additional workstation components can easily be mounted to the rail 104. For example, a flat screen monitor 22 can be attached to the rail 104 by a vertical support stand 132 similar to that shown in FIGS. 3 and 4. The support stand 132 would include a circular rail mounting bracket 134 having a finger 136 for engaging a T-slot of the rail 104 as shown in FIG. 12. It is further appreciated that the various components of the workstation 100 can be interchanged to suit the user's needs. For example, FIGS. 13 and 14 show the workstation 100 without the shelf 108. Here, a smaller shelf 138 having a mounting bracket 140 including a finger 142 is utilized. The smaller shelf 138 can be utilized if it is desired to support a computer monitor 18 or a flat screen monitor 22 at the same level as the desktop 106.

Figure 15:
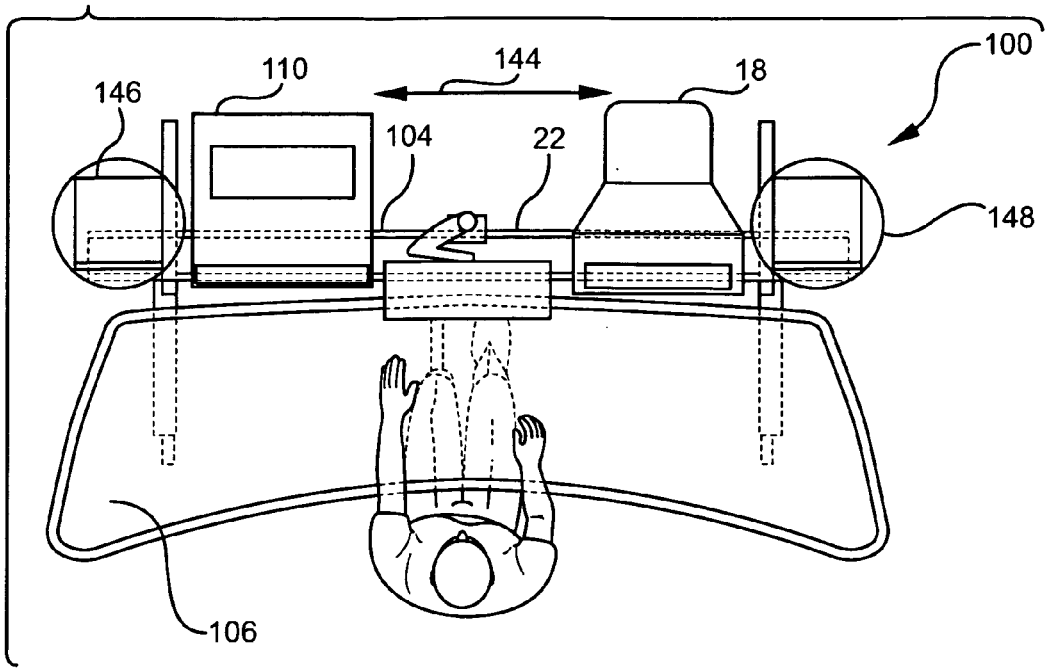
FIG. 15 is a top plan view of the workstation shown in FIG. 6.
Figure 16:
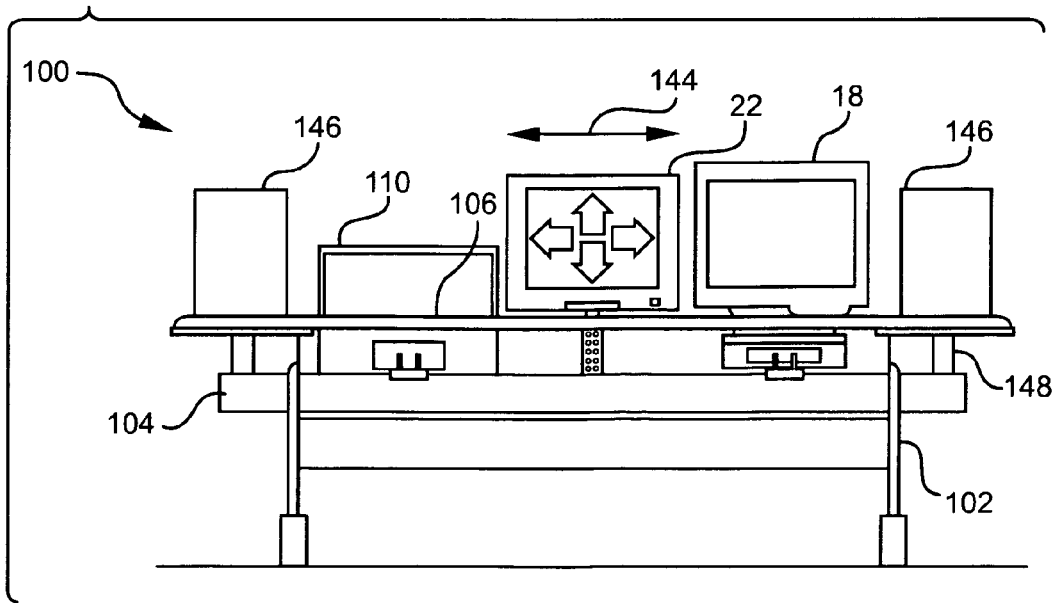
FIG. 16 is a front plan view of the workstation shown in FIG. 6.

As mentioned above, because the T-slots 112 extend the entire length of the circular rail extrusion 104, all components mounted to the rail can be horizontally adjusted to suit the user's needs. For example, a computer monitor 18, a flat screen 22 and/or a console box 110 mounted to the rail 104 can be moved horizontally as indicated by the arrows 144 in FIGS. 15 and 16. Additionally, the legs 102 can be positioned along the rail 104 so that the ends of the rail extend beyond the legs for mounting such additional equipment as speakers 146 supported on speaker stands 148. As a result of the present invention, a totally adjustable and interchangeable workstation system is provided.

While there has been described what is presently believed to be the preferred embodiments of the invention, those skilled in the art will realize that various changes and modifications may be made to the invention without departing from the spirit of the invention and it is intended to claim all such changes and modifications as forward in the scope of the invention.

What is claimed is:

1. A multi-media workstation comprising:

at least two substantially vertical frames;

a first rail extrusion mounted to said vertical frames and connecting said frames, said first rail extrusion including an upper surface, a lateral surface and a longitudinal slot formed in at least one of said upper and lateral surfaces;

a second rail extrusion having an upper surface, a lateral surface and a longitudinal slot formed in at least one of said upper and lateral surfaces, said second rail extrusion being mounted to said vertical frames and connecting said frames such that said upper surface of said second rail extrusion is disposed vertically lower than said upper surface of said first rail extrusion when said multi-media workstation is assembled;

a desktop unit having a finger engaged in said longitudinal slot of said first rail extrusion, wherein said desktop unit is able to be horizontally translated along a length of said first rail extrusion; and a console box containing a video display therein, said console box having a finger engaged in said longitudinal slot of said second rail extrusion, wherein said console box is able to be horizontally translated along a length of said second extrusion.

2. A multi-media workstation as defined in claim 1, wherein said longitudinal slots in said first and second rail extrusions are T-shaped.

3. A multi-media workstation as defined in claim 1, wherein said console box comprises an enclosed structure and contains a video display selected from the group consisting of computers, computer monitors, television monitors and flat monitors, said enclosed structure being horizontally translatable along a length of said second rail extrusion.

4. A multi-media workstation as defined in claim 1, wherein said first rail extrusion includes longitudinal slots formed in both of said upper surface and said lateral surface.

5. A multi-media workstation as defined in claim 1, wherein said second rail extrusion includes longitudinal slots formed in both of said upper surface and said lateral surface.

6. A multi-media workstation as defined in claim 1, wherein said vertical frames have first and second upper mounting portions, said first rail extrusion being mounted to said first upper mounting portion of said vertical frames and said second rail extrusion being mounted to said second upper mounting portion of said vertical frames.

7. A multi-media workstation comprising:

at least two substantially vertical frames;

a first rail extrusion mounted to said vertical frames and connecting said frames, said first rail extrusion including an upper surface, a lateral surface and a longitudinal slot formed in at least one of said upper and lateral surfaces;

a second rail extrusion having an upper surface, a lateral surface and a longitudinal slot formed in at least one of said upper and lateral surfaces, said second rail extrusion being mounted to said vertical frames and connecting said frames such that said upper surface of said second rail extrusion is disposed vertically lower than said upper surface of said first rail extrusion when said multi-media workstation is assembled;

a desktop unit having a finger engaged in said longitudinal slot of said first rail extrusion, wherein said desktop unit is able to be horizontally translated along a length of said first rail extrusion; and a console box for supporting a first piece of audiovisual equipment, said console box having a finger engaged in said longitudinal slot of said second rail extrusion, wherein said console box is able to be horizontally translated along a length of said second extrusion, wherein said first rail extrusion includes longitudinal slots formed in both of said upper surface and said lateral surface, and wherein said desktop unit is engaged in said longitudinal slot formed in said lateral surface of said first rail extrusion, and wherein said workstation further comprises a vertical support stand for supporting a second piece of audiovisual equipment, said vertical support stand being engaged in said longitudinal slot formed in said upper surface of said first rail extrusion.

8. A multi-media workstation as defined in claim 7, wherein said vertical support stand is adapted to support a video monitor.

9. A multi-media workstation comprising:

at least two substantially vertical frames;

a first rail extrusion mounted to said vertical frames and connecting said frames, said first rail extrusion including an upper surface, a lateral surface and a longitudinal slot formed in at least one of said upper and lateral surfaces;

a second rail extrusion having an upper surface, a lateral surface and a longitudinal slot formed in at least one of said upper and lateral surfaces, said second rail extrusion being mounted to said vertical frames and connecting said frames such that said upper surface of said second rail extrusion is disposed vertically lower than said upper surface of said first rail extrusion when said multi-media workstation is assembled;

a desktop unit having a finger engaged in said longitudinal slot of said first rail extrusion, wherein said desktop unit is able to be horizontally translated along a length of said first rail extrusion; and a console box for supporting a first piece of audiovisual equipment, said console box having a finger engaged in said longitudinal slot of said second rail extrusion, wherein said console box is able to be horizontally translated along a length of said second extrusion, wherein said second rail extrusion includes longitudinal slots formed in both of said upper surface and said lateral surface, and wherein said console box is engaged in said longitudinal slot formed in said lateral surface of said second rail extrusion, and wherein said workstation further comprises a vertical support stand for supporting a second piece of audiovisual equipment, said vertical support stand being engaged in said longitudinal slot formed in said upper surface of said second rail extrusion.

10. A multi-media workstation as defined in claim 9, wherein said vertical support stand is adapted to support a video monitor.

11. A multi-media workstation comprising:

at least two substantially vertical frames;

a first rail extrusion mounted to said vertical frames and connecting said frames, said first rail extrusion including an upper surface, a lateral surface and a longitudinal slot formed in at least one of said upper and lateral surfaces;

a second rail extrusion having an upper surface, a lateral surface and a longitudinal slot formed in at least one of said upper and lateral surfaces, said second rail extrusion being mounted to said vertical frames and connecting said frames such that said upper surface of said second rail extrusion is disposed vertically lower than said upper surface of said first rail extrusion when said multi-media workstation is assembled;

a desktop unit having a finger engaged in said longitudinal slot of said first rail extrusion, wherein said desktop unit is able to be horizontally translated along a length of said first rail extrusion; and a console box for supporting a first piece of audiovisual equipment, said console box having a finger engaged in said longitudinal slot of said second rail extrusion, wherein said console box is able to be horizontally translated along a length of said second extrusion, wherein said second rail extrusion includes longitudinal slots formed in both of said upper surface and said lateral surface, and wherein said second rail extrusion is square in cross-section and includes T-shaped longitudinal slots formed on each side of said second rail extrusion.

12. A multi-media workstation as defined in claim 1, further comprising a bracket assembly connected between said first and second rail extrusions.

13. A multi-media workstation comprising:

at least two substantially vertical frames;

a first rail extrusion mounted to said vertical frames and connecting said frames, said first rail extrusion including an upper surface, a lateral surface and a longitudinal slot formed in at least one of said upper and lateral surfaces;

a second rail extrusion having an upper surface, a lateral surface and a longitudinal slot formed in at least one of said upper and lateral surfaces, said second rail extrusion being mounted to said vertical frames and connecting said frames such that said upper surface of said second rail extrusion is disposed vertically lower than said upper surface of said first rail extrusion when said multi-media workstation is assembled;

a desktop unit having a finger engaged in said longitudinal slot of said first rail extrusion, wherein said desktop unit is able to be horizontally translated along a length of said first rail extrusion;

a console box for supporting a first piece of audiovisual equipment, said console box having a finger engaged in said longitudinal slot of said second rail extrusion, wherein said console box is able to be horizontally translated along a length of said second; and a bracket assembly connected between said first and second rail extrusions, wherein said bracket assembly comprises a flat panel extending between said first and second rail extrusions and at least one bracket for supporting said flat panel.

14. A multi-media workstation as defined in claim 13, wherein said flat panel encloses a cavity between said first rail extrusion, said second rail extrusion and said vertical frames for containing electrical wiring for said workstation therein.

15. A multi-media workstation comprising:

at least two substantially vertical frames;

a rail extrusion mounted to said mounting surface of said vertical frames and connecting said frames, said rail extrusion including a first portion having an upper surface, a lateral surface and a longitudinal slot formed in at least one of said upper and lateral surfaces and a second portion having an upper surface, a lateral surface and a longitudinal slot formed in at least one of said upper and lateral surfaces, said upper surface of said second portion being formed such that it is disposed vertically lower than said upper surface of said first portion when said multi-media workstation is assembled;

a desktop unit having a finger engaged in said longitudinal slot of said first portion of said rail extrusion, wherein said desktop unit is able to be horizontally translated along a length of said first portion of said rail extrusion; and a console box for supporting a first piece of audiovisual equipment, said console box having a finger engaged in said longitudinal slot of said second portion of said rail extrusion, wherein said console box is able to be horizontally translated along a length of said second portion of said rail extrusion.

16. A multi-media workstation as defined in claim 15, wherein said longitudinal slots in said first and second portions of said extrusion are T-shaped.

17. A multi-media workstation as defined in claim 15, wherein said first portion of said extrusion includes longitudinal slots formed in both of said upper surface and said lateral surface.

18. A multi-media workstation as defined in claim 17, wherein said desktop unit is engaged in said longitudinal slot formed in said lateral surface of said first extrusion portion, and wherein said workstation further comprises a vertical support stand for supporting a second piece of audiovisual equipment, said vertical support stand being engaged in said longitudinal slot formed in said upper surface of said first extrusion portion.

19. A multi-media workstation as defined in claim 15, wherein said second portion of said extrusion includes longitudinal slots formed in both of said upper surface and said lateral surface.

20. A multi-media workstation as defined in claim 19, wherein said console box is engaged in said longitudinal slot formed in said lateral surface of said second extrusion portion, and wherein said workstation further comprises a vertical support stand for supporting a second piece of audiovisual equipment, said vertical support stand being engaged in said longitudinal slot formed in said upper surface of said second extrusion portion.

* * * * *

UNITED STATES PATENT AND TRADEMARK OFFICE

CERTIFICATE OF CORRECTION

PATENT NO. : 7,406,803 B2
APPLICATION NO. : 11/545219
DATED : August 5, 2008
INVENTOR(S) : Haberman It is certified that error appears in the above-identified patent and that said Letters Patent is hereby corrected as shown below:

IN THE SPECIFICATION:

In Column 3, Line 38, now reads "the vertical flames"
should read --the vertical frames--

Signed and Sealed this

Twenty-first Day of October, 2008

JON W. DUDAS
*Director of the United States Patent and Trademark Office*